United States Patent [19]

Schraff

[11] Patent Number: 4,829,734

[45] Date of Patent: May 16, 1989

[54] CERAMIC FIBER INSULATION MODULE AND METHOD OF ASSEMBLY

[75] Inventor: Raymond J. Schraff, Cleveland, Ohio

[73] Assignee: Eltech Systems Corporation, Boca Raton, Fla.

[21] Appl. No.: 926,077

[22] Filed: Oct. 31, 1986

[51] Int. Cl.[4] ..... E04B 1/80; C04B 43/02

[52] U.S. Cl. ..... 52/404; 52/233; 52/506; 52/509; 52/748; 110/336; 110/339

[58] Field of Search ..... 52/506, 509, 232, 404, 52/741, 748; 110/331, 336, 337, 338, 339; 428/920

[56] References Cited

U.S. PATENT DOCUMENTS

| | | | |
|---|---|---|---|
| 3,292,326 | 12/1966 | Holzwarth | 52/232 |
| 3,819,468 | 6/1974 | Sauder et al. . | |
| 3,840,425 | 10/1974 | Finelli | 52/232 |
| 3,916,057 | 10/1975 | Hatch | 428/236 |
| 4,001,996 | 1/1977 | Byrd | 52/509 |
| 4,103,469 | 8/1978 | Byrd | 52/509 |
| 4,246,852 | 1/1981 | Werych | 110/336 |
| 4,273,879 | 6/1981 | Langer et al. | 521/91 |
| 4,276,332 | 6/1981 | Castle | 52/232 |
| 4,287,839 | 9/1981 | Severin | 52/506 |
| 4,336,086 | 6/1982 | Rast | 156/71 |
| 4,374,210 | 12/1982 | Fleming et al. | 52/221 |
| 4,411,621 | 10/1983 | Miller | 432/247 |
| 4,419,535 | 12/1983 | O'Hara | 52/232 |
| 4,425,749 | 1/1984 | Parker | 52/509 |
| 4,524,702 | 6/1985 | Miller et al. | 110/173 |

*Primary Examiner*—John E. Murtagh

*Attorney, Agent, or Firm*—John J. Freer

[57] ABSTRACT

A ceramic fiber insulation module is now provided from ceramic fiber units of finite length. The formation of the module can be initiated by folding an individual ceramic fiber strip or blanket, which is in unfolded condition, in a manner doubling the ends over on themselves. Then the double-over ends are folded up towards each other. As a result, the module, in cutaway, may be described as a "B-fold". The module presents an unbroken blanket surface for the hotface. The module also lends itself to fastening by cross-tying, between adjacent modules, to a backing member. Cross-tying can provide joint compression at the through joints which occur between modules.

12 Claims, 3 Drawing Sheets

CERAMIC FIBER INSULATION MODULE AND METHOD OF ASSEMBLY

BACKGROUND OF THE INVENTION

Ceramic fiber modules typically used as insulation components, such as in furnace linings, can have advantages of compressibility and flexibility over more rigid structure. Such modules, also sometimes referred to as mats, can be provided as U-shaped structures. For, example, in U.S. Pat. No. 4,411,621 U-shaped mats of ceramic fiber insulating material have been shown supported on an expanded sheet metal backing member. As shown most particularly in the figures of the patent, the U-shaped mats ma be alternating and interlocking such that the aperture of the U-shape of one mat is at least substantially filled by the depending legs of adjacent U-shaped mats.

It has also been known to simply prepare U-shaped mats without a filling, or having a filling provided by unconnected strips of additional blankets of fiber insulation. Thus in U.S. Pat. No. 3,819,468 U-shaped mats with and without filling have been shown for use in preparing larger insulation modules comprised of many such mats placed side-by-side. Both filled and unfilled U-shaped mats are disclosed.

It has also been known to arrange a fiber blanket in a continuum of U-shapes. The shapes can be pressed together thereby providing an accordion or pleated effect. In U.S. Pat. No. 4,336,086 such a continuous, U-shaped fiber blanket module is shown. As is also disclosed in this patent, if the. U-shapes of the continuum are left open, a second blanket of similar shape can be interlocked with the first for providing a double blanket layer in the module.

It has also been proposed, for corner construction, to first provide a U-shaped continuum of fiber blanket but with alternating short and long legs of folded blanket. A portion of the longer legs blanket can be cut away on one edge, and interleaved on the opposite edge with a continuum of U-shaped fiber blanket, wherein the openings of the U-shape interengage the uncut long legs of the first blanket. Such arrangement has been most particularly shown in U.S. Pat. No. 4,425,749 for providing an overall L-shaped insulating module for corners.

It would still nevertheless be desirable to provide modules, or fiber mats, which could be easily formed into individual units. Such units should lend themselves to ease of replacement, as during repair. It would also be desirable if the units could lend themselves to being readily compressed together during installation.

SUMMARY OF THE INVENTION

A ceramic fiber folded mat form has now been provided which meets the foregoing objectives. The units lend themselves to ease of installation, such as at the outset of preparing a furnace wall, or during subsequent wall replacement or repair. Moreover, as in a wall structure, it is a specific aspect of the invention that the adjacent ceramic fiber modules may be compressed together in installation. Additionally, the fiber module can be readily and fully supported. The "hot face radius" of the module, i.e., the lower portion of the module exposed to heat, will protect the support structure within the module from a direct heat path. Furthermore, even if heat induced module shrinkage is encountered, such will not expose the support structure to direct heat. Moreover, an efficient material and method is now disclosed for module or insulation structure repair as in the event of shrinkage. Or such material can be used in fresh structure construction.

Broadly, the present invention is directed to a resilient ceramic fiber insulation module from a unit of fiber of finite length, such fiber unit being at least substantially in folded condition in the module, with the module being adapted for ease of attachment to an external support as well as adapted for side-by-side compression of adjacent modules on attachment. The module comprises an unbroken bottom layer of ceramic fiber, the bottom outer surface thereof providing the module hot face, the center of the bottom layer in the folded condition being at least substantially the center of the fiber unit when it is in unfolded condition, which unit then extends continuously to two spaced apart and unbroken vertical side members of ceramic fiber, each side member having an outer face for contact with an adjacent module, which vertical side members together with the bottom layer form a U-shape. The remaining portions of the fiber unit from each side member are doubled over inwardly and downwardly, back against each vertical side, thereby forming two depending ceramic fiber interior leg members within the aperture of said U-shape, each leg member being doubled back against the adjacent vertical side members and forming a joint between each leg member and its adjacent vertical side member. There is thereby provided a top module cold face for positioning adjacent an external support, such module cold face having at least two folds provided by the doubled over fiber unit portions, and with there being at least one joint at the cold face.

In another aspect, the present invention is directed to an insulating assembly containing a multitude of ceramic fiber modules, each module being at least somewhat substantially in the form as aforedescribed, with adjacent modules being cross-tied to a backing member. In yet another aspect the invention is directed to the module as above-described, which module further contains ceramic fiber filler material. Still further, the invention includes side-by-side arrangements of any of the foregoing modules, such as for compression in wall or cover structures. Other aspects of the invention include the cross-tied connection for modules to a backing member, plus a joint structure of enhanced retardation of heat loss using a heat resistant active material.

DESCRIPTION OF THE PREFERRED EMBODIMENTS

As used herein, the terms "mat" and "module" are interchangeable and refer to a unit of folded ceramic fiber insulation, and when more specifically relating to the present invention refer to a "B-shape" may or module or t a variation thereof, i.e., a filled B-shape module. The ceramic fiber for the module can originate in a form of finite length, e.g, strip or blanket form and from such form can be folded into module configuration. The ceramic fiber useful in the present invention can be any of such material as may be used as insulation material and lends itself to preparation in a blanket or strip form having resilient characteristic, i.e., ease of folding without Typical such ceramic fiber materials are the alumina-silica refractory fibers capable of withstanding exposure- to elevated furnace temperature. The individual modules will be useful in any installation where thermal insulation for such fiber is serviceable. Typical applications will include furnace chamber walls, roofs and doors as well as soaking pit and ladle covers. The module also lends itself to use as a repair unit for installation is existing ceramic fiber insulation assemblies.

Figure 1:
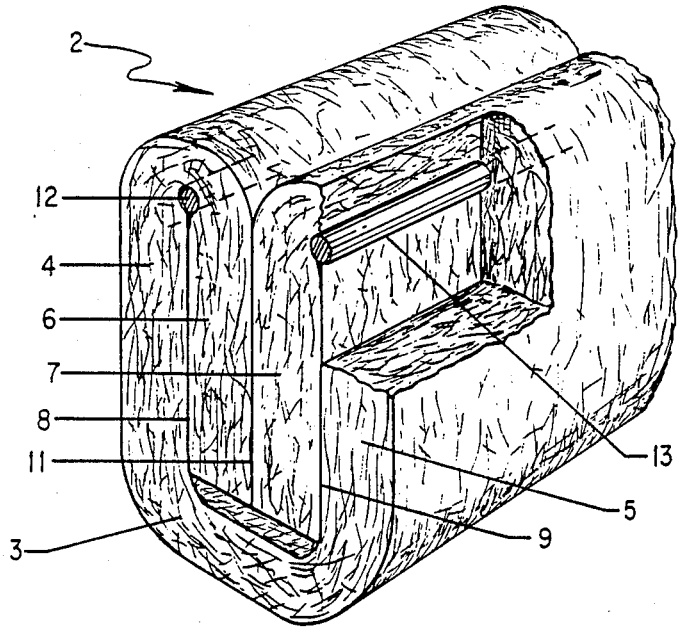
FIG. 1 is an isometric view of a resilient ceramic fiber module folded into the form of the present invention.

Referring then to FIG. 1, a resilient ceramic fiber module, or "B-shape" module, of the present invention shown generally at 2 has an unbroken bottom layer, or radius, of ceramic fiber 3. This bottom layer 3 extends to a pair of upright unbroken vertical side members 4,5. The module side members 4,5 together with the bottom blanket layer 3 are in the form of a U-shape.

The remaining ceramic fiber material for the module 2 extending from the side members 4,5 is the doubled back to provide two depending interior leg members 6,7. As shown in the Figure and as a preferred embodiment these interior ceramic fiber leg members 6,7 substantially fill the void of the U-shape provided by the bottom layer 3 and the side members 4,5. The interior leg members 6,7, form an interior leg-and-side member joint 8,9 between each leg member 6,7 and adjacent side member 4,5. By the doubling back of the ceramic fiber to form the leg members 6,7 there is also provided therebetween a central joint 11. As is also shown in the Figure, at the uppermost end of earn leg-and-side member joint 8,9 are support rods 12,13. Owing to the positioning of these support rods 12,13 and the presence of the central joint 11, it is contemplated that the bottom layer 3 will always provide the hot face of the B-shape module 2.

Figure 2:
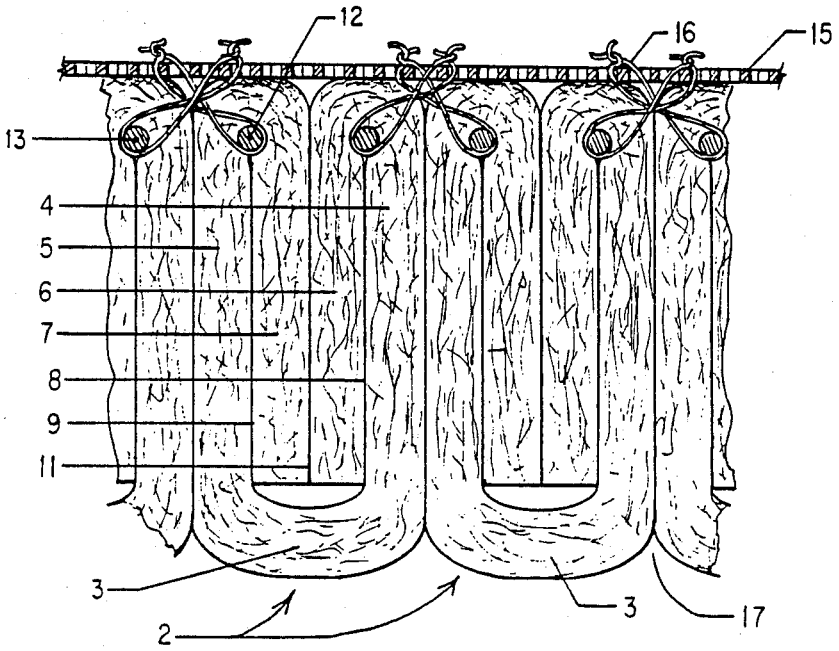
FIG. 2 is a cross-sectional end view of a portion of an insulation wall having adjacent invention modules of FIG. 1 fastened in cross-tying arrangement to a backing member.

As has been mentioned hereinbefore, the B-shape module 2 of the present invention lends itself to a preferred cross-tying arrangement to a backing member. Referring then to FIG. 2, several modules 2 are shown arranged along a backing member 15 which provides external support for the modules. Each module 2, as in FIG. 1, contains a bottom layer 3, side members 4,5 and interior leg members 6,7. Likewise, the leg-and-side member joints 8 9 each have support rods 12,13. The support rods 12,13 are fastened to the backing member 15 by a fastening element 16. Each fastening element 16 extends- from a support rod 12,13 across an inter-module through joint 17 located between modules 2 and is thereafter affixed to the backing member 15 at a region thereof that is near the adjacent B-shape module 2. Alternatively, the fastening element 16 of the adjacent B-shape module 2 extends back across the same through joint 17 to the backing member 15. This extension of fastening elements 16 back and forth across the through joint 17 provides for the cross-tying of the fastening elements 16. Such cross-tying, which is at optional fastening feature, can be useful for compressing adjacent modules 2 together and thereby retarding undesirable heat loss from the through joints 17.

Figure 3:
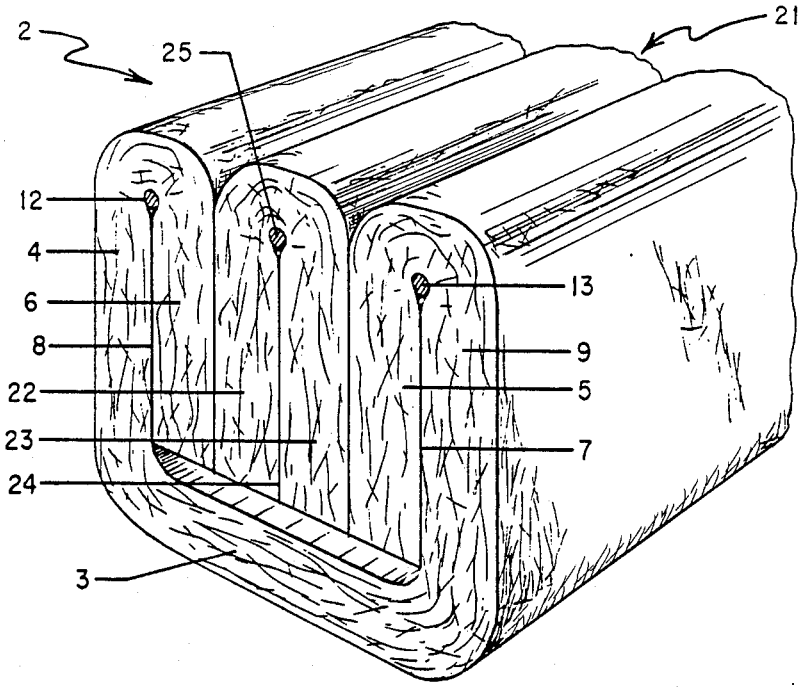
FIG. 3 is an isometric view of the module of FIG. 1 containing an insert filler module of U-fold construction.

In FIG. 3, the B-shape module 2 has been expanded t contain a U-fold module 21 as filler. As before, the B-shape module 2 has a bottom layer 3, side members 4,5 and interior leg members 6,7. Also, the side members 4,5 and leg members 6,7 have joints 8,9 therebetween. Support rods 12,13 are also employed. By expansion of the central joint 11 of the module of FIG. 1, there is now interposed between the leg members 6,7 the U-fold module 21. This U-fold module 21 has depending leg members 22,23 at least substantially filling the space between the leg members 6,7 of the B-shape module 2. Between the depending leg members 22,23 of the U-fold module 21 is a central joint 24. At the top of this central joint 24 is a support rod 25 for the U-fold module 21.

Figure 4:
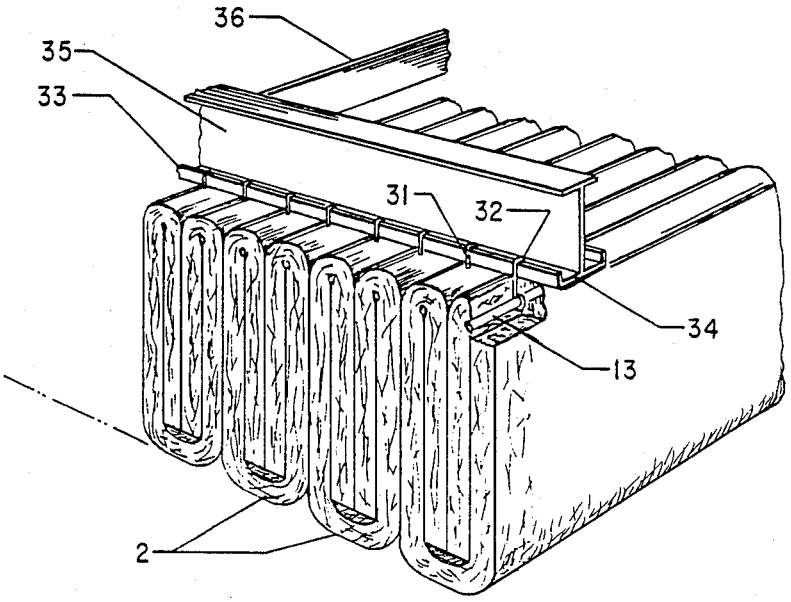
FIG. 4 is a perspective view of a portion of a cover structure containing suspended modules of FIG. 1 adapted for lateral compression.

In FIG. 4, a series of the B-shape modules 2 are shown in an adjacent row for service in a cover such as for a soaking pit as has been more particularly described in U.S Pat. No. 4,524,702. As is shown in FIG. 4, a support rod 13 for each module 2 is interengaged by a wife connector 31 terminating upwardly in a hook 32. The hook 32 is hooked around the raised edge section 33 that rises from the bottom flange 34 of a support beam 35 providing external support. Each of the support rods 13 has a wire connector 31 for engaging with the raised edge section 33 of the support beam 35. A pair or more of support beams 35 are generally connected by stiffeners 36 thereby forming an overhead support structure from which the B-shape modules 2 depend. These depending modules 2 then form a cover over the underlying aperture, e.g., the aperture of a soaking pit, not shown.

Figure 5:
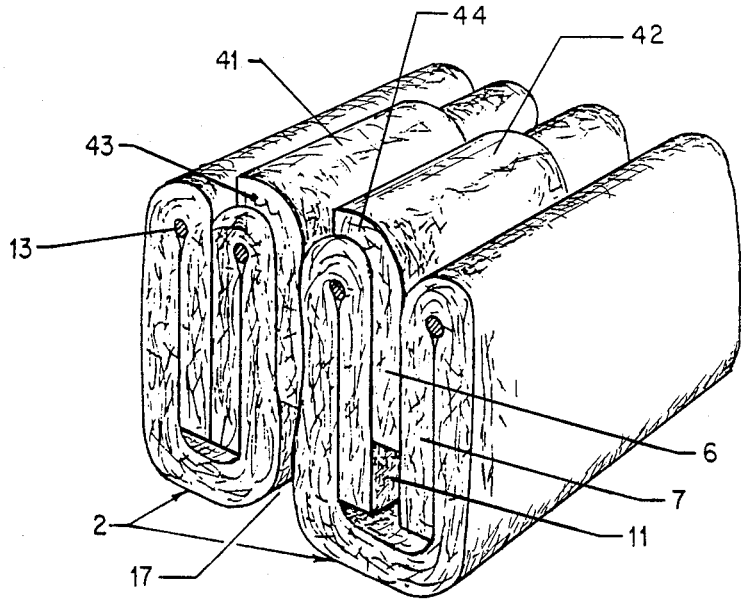
FIG. 5 is an isometric view of a ceramic fiber module structure having interleaved filler elements.

Referring then to FIG. 5, two B-shape modules 2, placed side-by-side, as in a wall or cover insulation structure, have two inserted filler elements 41,42. The filler element 41 is positioned at the inter-module through joint 17. This filler element 41 is shown partially inserted into the joint 17 although it is understood that it could be fully extended the length of the module 2. At its upper section, the filler element 41 is curved around one top fold of the module 2. This upper curved portion 43 of the filler element 41 can be useful in helping to retain the element 41 between the modules 2. However it is to be understood that suitable filler elements 41 can simply be sheets interleaved between the modules 2 the sheet being free from any upper curved portion 43. Whether in simple vertical form or in such form as depicted in the Figure with an upper curved portion 43, the filler element 41 can be compressed between the modules 2 such as during construction of a ceramic fiber insulation structure or during repair thereof. For additionally molding the filler element 41 firmly in shape, connectors, not shown, extending from the support rods 13 can penetrate through the filler element 41 and attach to a backing member, not shown.

In similar manner, the filler element 42 positioned between the central fold 11 of a module 2, can likewise have an upper curved portion 44 which can conform, all or in part, to an upper curved portion of one of the top folds of the module 2. Moreover, this upper curled portion 44 can be penetrated by connectors, not shown, from a support rod 13 to a backing member, not shown. The filler element 42 can extend downwardly into the central told the full length, or more, of the interior blanket leg members 6,7. It is to be understood that the filler elements 41,42 may be used only at the through joint 17, or only at the central folds 11, or in combination as shown in the Figure.

Figure 6:
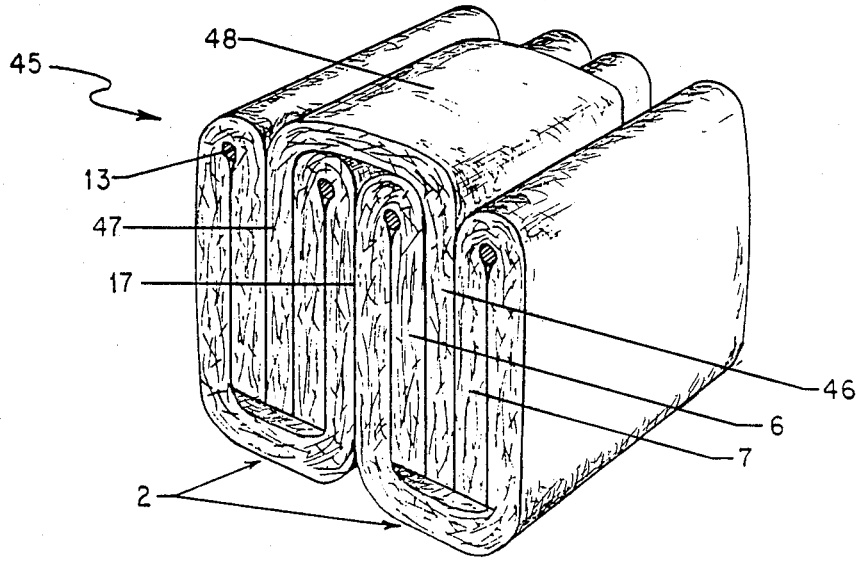
FIG. 6 is an isometric view of a ceramic fiber module structure having an interengaging filler element across the through joint.

Referring then to FIG. 6, a pair of adjacent B-shape modules 2 are interconnected by an inverse. U-shaped filler mat 45. This filler mat has depending leg members 46,47 that penetrate into and fill the central fields of each individual module 2. The filler mat 45 additionally has an upper blanket layer 48 that crosses over the inter-module through joint 17. By this positioning across the joint 17, heat loss from the through joint 17, can be greatly reduced to eliminated. When the support rods 13 of the modules 2 are fastened by connectors, not shown, to a backing member, also not shown, such connectors can penetrate through the upper blanket layer 48 thereby holding the filler mat 45 in place. Additionally, the depending leg members 46,47 of the mat 45 can be compressed between the interior blanket leg members 6,7 of the modules 2 to further assist in maintaining the filler mat 45 in place.

To prepare the B-shape module 2, a ceramic fiber strip or blanket of finite length, in unfolded condition, can be folded in two ways. In a first way, the unfolded blanket in flat, horizontal position is taken at tooth ends and the end sections are folded, e.g., upwardly, to form a generally U-shaped structure. The extra fiber material from each side 4,5 of the U is then doubled back on itself to form two depending leg members 6,7 that are present in the opening of the U-shape. In a second folding method, the unfolded blanket in flat position is taken at each end and the ends are folded back on themselves, i.e., the ends are doubled back. In this position the blanket is still essentially flat. In this position the leg members 5,6 are atop the side members 4,9. Then the doubled end sections are raised upwardly and against one another, thereby forming the module 2. In either folding method, support structure, such as rods 12,13, can be inserted in the module during the folding operation. It is preferred that the module 2 not contain a gap at the central joint 11 to provide for uniformity of insulation material between the cold and hot face of the module 2. It is to be understood however that the interior leg members 6,7 need not completely fill the aperture of the U-shape, i.e., depend into touching relationship with the bottom layer 3.

For preparing an assembly of modules in a structure such as a furnace wall structure, individually formed modules 2 containing support rods 12 and 3 can be positioned side-by-side with the cold face exposing the central joint 11 to a backing member 15. Fastening elements, e.g., wire ties 16, can penetrate through a blanket fold t wrap around the support rods 12,13. The opposite end of the ties 16 can then be twisted around adjacent structure of the backing member 15. The twisted wire ties for the fastening elements 16 can be especially useful in the cross-tying arrangement.

Referring now again to FIG. 2, it may be desirable to have extra insulation against the backing member 15, e.g., an additional ceramic fiber insulation blanket can be laid along the backing member 15. Also, some to all of the twisted wire ties 16 may be replaced by alternate fastening means as are well known in the art, including formed wire hooks and J-bolts. The twisted wire ties 16, such as disclosed in U.S. Pat. No. 4,411,621, are especially useful for preparing the cross-tied assembly. Formed wire hooks can be particularly serviceable where the fastening elements are to be in sliding engagement with a backing member. The backing member 15 is preferably foraminous to be light weight, and representative materials include metal mesh and other perforate backing member structures. Moreover, the cross-tied arrangement is an aspect of the invention that has broader implications than to just the B-shape module. Thus any such adjacent modules having blanket side members 4 at a through joint 17 and with a connecting fold around a support rod 13 will serve for the cross-tied assembly. It can therefore be useful where adjacent modules are one or more, or a mixture of, B-shape as well as S-fold, U-fold, W-fold or related shapes, e.g., corrugated shape.

Referring to FIG. 3, combinations of fastening elements can be employed for connecting the support rods 12,13,25 to a backing member. Thus, for example, the support rod 25 for the U-fold module 21 may be connected to a backing member by a J-bolt. Then the support rods 12,13 of the B-shape module 2 can be fastened by twisted wire ties, e.g., in the cross-tie pattern. It is also contemplated that a variety of filler shades for the B-shape modules 2, can be useful in addition to the U-fold module 21 filling. Thus, simple strips of ceramic fiber may be inserted at the central joint 11 of the module 2. These can essentially provide extra, loose leg members 6,7 at this joint 11. The additional filler material need not have support structure such as internal rods, but rather can be supported by the bottom layer 3 of the module 2 and/or by compression of the filler between the leg members 6,7. In addition to a U-fold module 21 or strip filler, further filler material for the central joint 11 of the module 2 can be provided by ceramic fiber folded in any of the usual forms, e.g., S-fold or W-fold shapes. It will be appreciated that where a wider filled B-shape module 2, such as depicted in FIG. 3, can be used in place of the basic B-shape module 2 of FIG. 1, the greater width of the wider, filled module can lead to fewer modules along a fixed length of an insulation assembly such as a wall or the like. Thus the wider, filled B-shape will provide for a lower number of through joints 17. When reduction of through joints 17 is desirable, the wider, filled module will be the module of choice where it will be otherwise serviceable. Moreover, wider; filled modules can be particularly useful when employed as corner structures in wall assemblies or the like.

Referring now most particularly to FIGS. 5 and 6, where filler elements 41,42 or a filler mar 45 or the like are employed, these can be typically of the same or similar ceramic fiber insulation construction as is used in the preparation of the modules 2. It is however of particular interest to use, especially for the filler elements 41,42, a heat resistant and intumescent composite that can be typically available in sheet form. This composite will contain an active material that owing to its intumescent property will expand upon heating and additionally provide insulation characteristic in expanded form. A suitable intumescent sheet material has been disclosed for example in the U.S. Pat. No. 3,916,057. Such sheet materials generally contain an expandable mica, e.g., vermiculite, as active material. This material can be placed into a typically fiber like structure, such as during sheet formation, with the fiber like structure being provided, for example, by ceramic fiber such as would be useful in the insulation modules 2. Particularly when the sheet will be used as the filler element 42 in the module central fold 11, the element 42 need not be capable of withstanding the same elevated temperature such as for the bottom blanket layer 3 of the module 2. However, as will be understood particularly by reference to FIG. 5, the filler element 43 between the modules 2 may face more elevated temperatures owing to its positioning in the through joint 17.

It is particularly desirable to provide such filler elements 41,42 as a heat resistant and intumescent composite. Then, during utilization of the insulation structure, the intumescence of the filler element 41,42 can provide swelling at the through joint 17 or the central fold 11 and thereby assist in sealing joints and folds 17,11 or in compressing together module leg members. Such compression can also provide for retardation of heat loss through the structure. It is also contemplated that the filler mat 45, as depicted in FIG. 6, can be a sheet form composite having intumescent active material. Thus, the upper blanket layer 48 of this filler mat 45 can not only seal the inter-module through joint 17, but also, upon intumescence, the swelling of the depending leg members 46,47 of the mat 45, can provide pressure to additionally seal the joint 17. The filler elements 41,42 and mat 45 will likewise be useful in repair or reconstruction of existing insulation structure. For example, a filler element 41 can be simply interleaved by insertion between adjacent modules. Or where a module contains an interfold, a filler element 42 can be likewise interleaved in such fold. This repair or reconstruction operation can be utilized where the modules are in U-fold, S-fold, W-fold or B-shape or the like, e.g., corrugated folds. When such reconstruction or repair is undertaken in such manner using a sheet of the composite material that will intumesce upon heating, the expansion on intumescence will provide desirable compression of the structure for retarding further immediate need for additional reconstruction and repair.

For the support structure, elongated metal elements such as rods are most always contemplated, although hollow tubing or pipe or other support elements, e.g., penetrating hook-shaped fastening elements, may be used. Preferably the support elements are rods, and most preferably they are metal rods, e.g., steel or stainless steel, although ceramic and other materials may be employed. The backing members for the fastened assembly are typically metallic, such as steel, and most always are perforate. Preferably for ease of fastening, a steel mesh is used as the backing member. The fastening elements between the support structure and the backing member can also be metal elements.

In assembled condition, the B-fold module will at least virtually always be used such that the central joint will be at the cold face. Thus the module exposes a continuous bottom layer to the hot face. This not only protects the support structure from heat exposure, but also provides for desirable reduction in heat loss through an insulation assembly of such modules.

Although mention may be made herein with reference to a vertical or upright direction or the like, it is to be understood that such should not be construed as a limitation where other orientation could be apparent to those skilled-in-the-art.

I claim:

1. A resilient ceramic fiber insulation module from a unit of fiber of finite length, said fiber unit being at least substantially in folded condition in said module, with the module being adapted for ease of attachment to an external support as well as for side-by-side compression of adjacent modules on attachment, the filter of said module consisting essentially of:

an unbroken bottom layer of ceramic fiber, the bottom outer surface thereof providing the module hot face, the center of the bottom layer in the folded condition being at least substantially the center of said fiber unit when it is in unfolded condition, which unit then extends continuously to;

two spaced apart and unbroken vertical side members of ceramic fiber, each side member having an outer face for contact with an adjacent module, which vertical side members together with said bottom layer form a U-shape, the remaining portions of said fiber unit from each side member being doubled over inwardly and downwardly, back against each vertical side thereby forming two depending ceramic fiber interior leg members, within the aperture of said U-shape and at least substantially filling said U-shape aperture, each leg member being doubled back against the adjacent vertical side members and forming a joint between each leg member and its adjacent vertical side member, as well as being double-backed in face-to-face contact with each other, thereby providing a top module cold face for positioning adjacent an external support, said module cold face having two folds provided by said doubled over fiber unit portions, and with there being a central joint at the cold face positioned between said double-backed interior leg members.

2. The ceramic fiber module of claim 1, wherein said fiber unit in unfolded condition has at least substantially uniform thickness.

3. The ceramic fiber module of claim 1, wherein said interior leg members contact the interior face of said bottom layer.

4. The ceramic fiber module of claim 1, wherein a support structure for said module is contained within at least one of said joints between adjacent leg and side members.

5. The ceramic fiber module of claim 4, wherein said support structure comprises an elongated metal element extending along the upper portion of said joint.

6. The ceramic fiber module of claim 5, wherein said elongated metal element is connected by at least one fastening element to a backing member.

7. The ceramic fiber module of claim 6, wherein said backing member is a perforated metal member.

8. The ceramic fiber module of claim 5, wherein each leg-and-side member joint contains a rod and each rod is connected by a fastening element to a backing member.

9. The method of preparing a ceramic fiber insulating assembly adapted for reduced heat loss at the through joints between fiber modules contained within said assembly, which method comprises:

establishing a multitude of ceramic fiber insulation modules in side-by-side relationship adjacent to a backing member, with adjacent modules having inter-module through joints and having module vertical side members forming said joints, with the side members being folded away from said joint forming a ceramic fiber fold;

providing said folds with internal support elements at least for the folds adjacent the through joints; and connecting such internal support element to said backing member by cross-tying fastening elements from a support element across an inter-module through joint thereby compressing adjacent modules together for reducing heat loss through the insulation assembly.

10. An insulating assembly containing a multitude of individual fiber units in module form and side-by-side position, said assembly being adapted for use as ceramic fiber insulation structure, which assembly comprises:

a support structure positioned externally to said modules;

internal support elements interengaged within folds in said ceramic fiber modules;

fastening elements connecting said support elements within the ceramic fiber modules to said external support structure by cross-typing from said support elements across an inter-module through joint to said external support structure; and ceramic fiber modules, arranged side-by-side against one another, each module comprising:

an unbroken bottom layer of ceramic fiber, the bottom outer surface thereof providing the module hot face, the center of the bottom layer when the fiber is in folded condition being at least substantially the center of said fiber unit when it is in unfolded condition, which unit then extends continuously to;

two spaced apart and unbroken vertical side members of ceramic fiber, each side member having an outer face for contact with an adjacent module, which vertical side members together with said bottom layer form a U-shape, the remaining portions of aid fiber unit from each side member being doubled over inwardly and downwardly, back against each vertical side; thereby forming two depending ceramic fiber interior leg members within the aperture of said U-shape, each leg member being doubled back against the adjacent vertical side members and forming a joint between each leg member a top module cold face for positioning adjacent said external support structure, said module cold face having at least two folds provided by said doubled over fiber unit portions, and with there being at least one joint at the cold face.

11. The method of claim 9, wherein said connecting for cross-typing fastening elements connect modules selected from the group consisting of U-fold, S-fold, W-fold and B-shape modules, as well as mixtures thereof.

12. A resilient ceramic fiber insulation module from a unit of fiber of finite length, said fiber unit being at least substantially in folded condition in said module, with the module being adapted for ease of attachment to an external support as well as for side-by-side compression of adjacent modules on attachment, said module comprising:

an unbroken bottom layer of ceramic fiber, the bottom outer surface thereof providing the module hot face, the center of the bottom layer in the folded condition being at least substantially the center of said fiber unit when it is in unfolded condition, which unit then extends continuously to;

two spaced apart and unbroken vertical side member of ceramic fiber, each side member having an outer face for contact with an adjacent module, which vertical side members together with said bottom layer form a U-shape, the remaining portions of said fiber unit from each side member being doubled over inwardly and downwardly, back against each vertical side; thereby forming two depending ceramic fiber interior leg members, within the aperture of said U-shape, each leg member being doubled back against the adjacent vertical side members and forming an inner unit joint between each leg member and its adjacent vertical side member; thereby providing a top module cold face for positioning adjacent an external support, said module cold face having at least two folds provided by said double over fiber unit portions, and with there being at least one outer unit joint at the module cold face;

an elongated fiber module support rod extending along the upper portion of said inner unit joints which are between adjacent leg and side members; and fastening elements connecting each said support rod by cross-typing arrangement across an intermodule through joint to a backing member.

* * * * *